United States Patent [19]

Coletta

[11] Patent Number: 4,671,899

[45] Date of Patent: Jun. 9, 1987

[54] CARBURETION DEVICE FOR INTERNAL COMBUSTION ENGINES

[76] Inventor: Timothy C. Coletta, 5 Cosway, Apartment 4, Fairfield, Ohio 45014

[21] Appl. No.: 823,340

[22] Filed: Jan. 28, 1986

[30] Foreign Application Priority Data

Jan. 29, 1985 [DE] Fed. Rep. of Germany ..... 3502891

[51] Int. Cl.[4] ..... F02M 19/03

[52] U.S. Cl. ..... 261/63; 261/76; 261/DIG. 39; 261/64.4

[58] Field of Search ..... 261/63, 64 C, 76, DIG. 8

[56] References Cited

U.S. PATENT DOCUMENTS

| | | | |
|---|---|---|---|
| 195,585 | 12/1877 | Dieckmann . | |
| 415,978 | 11/1889 | Regan . | |
| 798,150 | 9/1905 | Wolgamott . | |
| 867,604 | 10/1907 | Rothe . | |
| 911,105 | 2/1909 | Abel | 261/64 C |
| 1,038,262 | 9/1912 | Anstice . | |
| 1,039,008 | 9/1912 | Anderson . | |
| 1,042,982 | 10/1912 | Sliger | 261/64 C |
| 1,047,153 | 12/1912 | Benham . | |
| 1,153,999 | 9/1915 | Carpenter . | |
| 1,253,766 | 1/1918 | Alden . | |
| 1,293,804 | 2/1919 | Kocourek | 261/DIG. 8 |
| 1,460,369 | 7/1923 | DeGuire . | |
| 2,093,011 | 9/1937 | Grosz | 261/76 |
| 2,096,407 | 10/1937 | Reitmeyer . | |
| 2,103,067 | 12/1937 | Evans | 261/76 |
| 2,312,151 | 2/1943 | Crabtree . | |
| 2,430,852 | 11/1947 | Allen . | |
| 2,613,067 | 10/1952 | Goodyer | 261/76 |
| 3,338,223 | 8/1967 | Williams . | |
| 3,447,514 | 6/1969 | Trafford . | |
| 3,467,072 | 9/1969 | Toesca | 261/76 |
| 3,713,429 | 1/1973 | Dwyre . | |
| 3,790,139 | 2/1974 | Stephenson . | |
| 3,892,547 | 7/1975 | Tucker | 261/96 |
| 3,999,526 | 12/1976 | Asfar . | |
| 4,011,874 | 3/1977 | Fortino . | |
| 4,031,873 | 7/1977 | Tyler . | |
| 4,370,304 | 1/1983 | Hendriks et al. | 261/76 |

*Primary Examiner*—Tim Miles

*Attorney, Agent, or Firm*—Frost & Jacobs

[57] ABSTRACT

A carburetion device comprises a vacuum-tight vaporization chamber into which fuel and air are drawn by the vacuum produced by the engine. The vaporization chamber is supplied fuel and air through fuel and air conduits. The air supply conduit terminates at its outlet end in the vaporization chamber adjacent a barrier which contains one or more diffusion orifice. The engine vacuum draws the fuel and the air from the conduits, through the diffusion orifice, and into a vapor supply conduit which conducts the vaporized fuel/air mixture to the engine cylinders. The inlet end of the air supply conduit is provided with a flow-resistant valve so that a partial vacuum is maintained in the vaporization chamber. The flow resistant valve may be adjustable to enable adjustment of the richness and leanness of the engine. A means may be provided for adjusting the distance between the outlet end of the air supply conduit and the barrier containing the diffusion orifice. There also may be provided a choke assembly for regulating the richness of the vaporized fuel/air mixture and a throttle assembly.

18 Claims, 5 Drawing Figures

CARBURETION DEVICE FOR INTERNAL COMBUSTION ENGINES

BACKGROUND OF THE INVENTION

The present invention relates to a carburetion means for an internal combustion engine. More particularly, the invention relates to a fuel vaporization chamber which operates on the vacuum provided by the engine to provide a homogenous vaporized fuel/air mixture to the engine cylinders.

Standard internal combustion engines rely upon a pressure differential to move the fuel/air mixture into the combustion chamber associated with each cylinder. During the intake stroke of the piston of a conventional engine, the piston recedes in the cylinder bore and the inlet valve is simultaneously opened at the inlet port to admit the fuel/air mixture. The receding piston creates a partial vacuum in the combustion chamber and throughout the intake manifold. This vacuum draws air through the carburetor where, in the typical jet-type carburetor, liquid fuel droplets are sprayed into the passing air to create a misty fuel/air mixture.

The nature and quality of the combustion of the fuel-/air mixture in the combustion chamber depends upon numerous factors. One of the most significant of these factors is the degree to which the fuel droplets released by the carburetor are atomized and eventually vaporized on their way to the combustion chamber. Ideally, the fuel/air mixture in the combustion chamber should be in a gaseous state—an ideal usually not attainable by a conventional jet-type carburetor. Fuel in a liquid state, suspended in the combustion chamber as a mist or droplets, will not ignite and yield energy as effectively as totally vaporized, gaseous fuel. Such unvaporized fuel does not burn completely during the combustion stroke of the cylinders. Instead, such unburned fuel is expelled into the exhaust system where it continues to burn, heating the engine and requiring surplus pollution control devices.

Vaporizing carburetion devices have been proposed in the prior art to overcome the deficiencies of the conventional jet-type carburetor. To achieve total vaporization, prior art carburetion devices have been developed which provide a reservoir of fuel through which atmospheric air is bubbled to produce a vapor in the reservoir above the fuel level. The vapor thus produced is drawn into the engine by the engine vacuum.

Some such carburetion devices provide the benefit of truly vaporized fuel but all perform inconsistently and are cumbersome on a moving engine. For example, if mounted on a typical automobile, such a carburetion device provides inconsistent operation because the motion of the automobile results in splashing and surging of the fuel within the reservoir. Furthermore, such devices tend to be cumbersome because a large surface area of fuel is required in the reservoir to accomplish effective vaporization.

SUMMARY OF THE INVENTION

It is an object of the present invention to provide a carburetion device which produces truly vaporized fuel for the engine. It is a further object to provide a compact carburetor vaporization device which provides consistent operation regardless of the motion of the device or the engine on which it is mounted.

Additional objects, advantages, and novel features of the invention will be set forth in part in the description which follows, and in part will become apparent to those skilled in the art upon examination of the following, or may be learned by practice of the invention. The objects and advantages of the invention may be realized by means of the devices and methods described in the claims.

To achieve the above objects, there is provided a vacuum-tight vaporization chamber into which fuel and air are drawn by the vacuum produced by the engine. Fuel supply and air supply conduits are provided into the vaporization chamber. The air supply conduit terminates at its outlet end in the vaporization chamber adjacent a barrier which contains one or more diffusion orifice. The engine vacuum draws the fuel and the air supplied by the fuel and air supply conduits, through the diffusion orifice and into a vapor supply conduit which conducts the vaporized fuel/air mixture to the engine cylinders. The inlet end of the air supply conduit is provided with a flowresistant valve so that a partial vacuum is maintained in the vaporization chamber. The flow resistant valve may be adjustable to enable adjustment of the richness and leanness of the engine. A means may be provided for adjusting the distance between the outlet end of the air supply conduit and the barrier containing the diffusion orifice. There also may be provided a choke assembly for regulating the richness of the vaporized fuel/air mixture and a throttle assembly.

The present invention provides numerous advantages and benefits. Fuel efficiency is improved because no splash or excess fuel is provided to the engine cylinders. The present invention eliminates the need for a fuel pump. By providing fuel vapors rather than liquid fuel no unburned fuel is expelled through the exhaust and a typical internal combustion engine runs cleaner and cooler. Consequently, less stress is placed on the exhaust system and the cooling system. The improved efficiency of operation and quality of combustion may eliminate the need for catalytic convertors and other surplus pollution devices. Furthermore, the cooler running engine enables many engine components and accessories, including the present invention to be made of light, inexpensive, non-metallic materials such as plastic.

DESCRIPTION OF THE DRAWINGS

Other objects and advantages of the invention will become apparent upon reading the following detailed description and upon reference to the drawings in which.

DETAILED DESCRIPTION OF THE PREFERRED EMBODIMENT

Figures 1A, 1B:
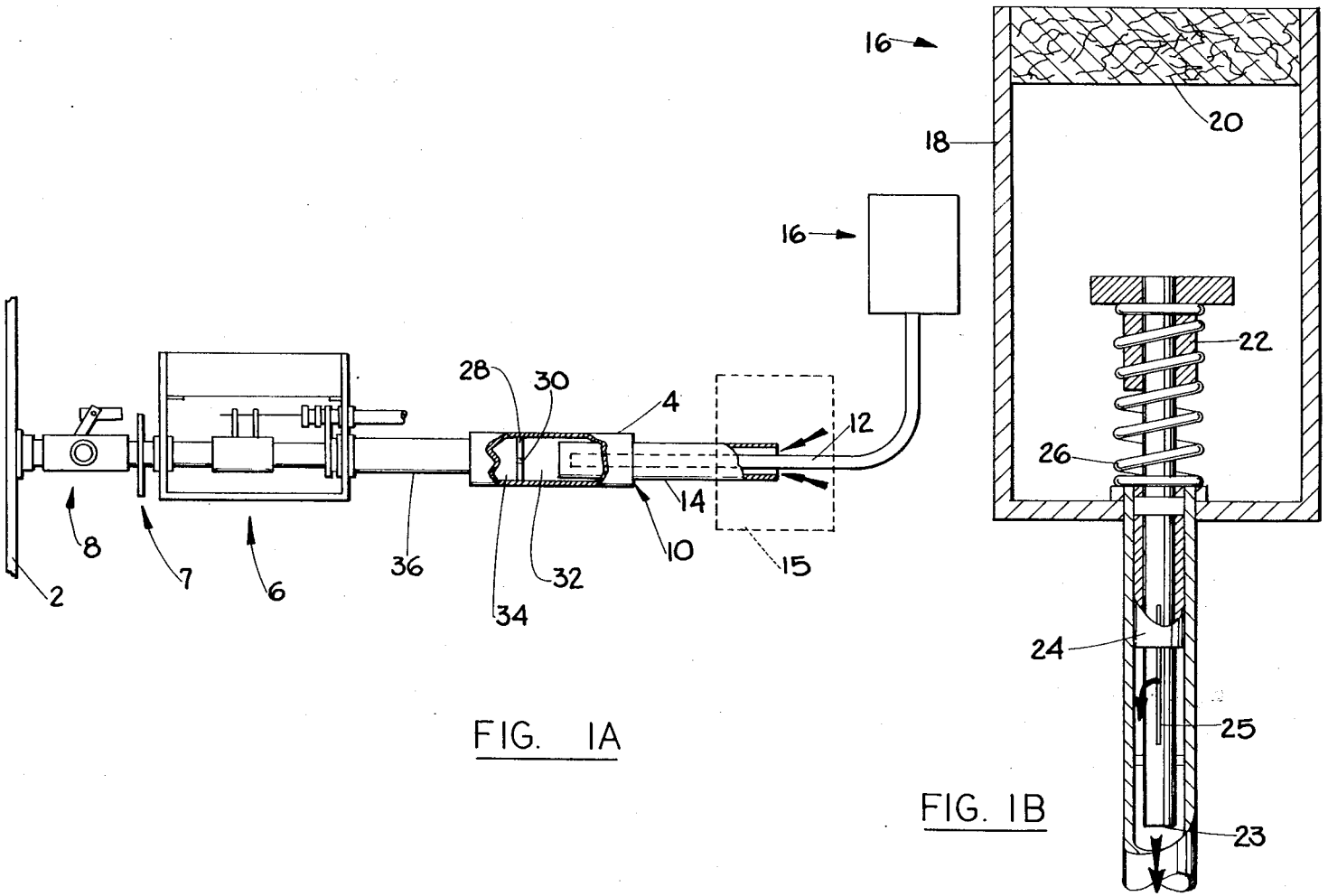
FIG. 1A is a fragmentary cross-sectional elevational view of the present invention.
FIG. 1B is an enlarged view of the valve illustrated in FIG. 1.

Turning first to FIG. 1A, there is illustrated an elevational view of the present invention. The present invention includes three functional parts mounted in a series attached to an inlet manifold diagrammatically illustrated at 2. The functional parts are a vaporization chamber 4, a choke assembly 6, and a throttle 8.

Turning first to the vaporization chamber 4, a hollow chamber is provided to permit vaporization of the fuel and mixture of that fuel with air for supplying the internal combustion engine. A separate vaporization chamber 4 may be provided for each cylinder or a single vaporization chamber 4 may be provided to supply the needs of all of the cylinders of a particular engine. The vaporization chamber 4 can be made of any suitable material and can conform to any desired cross-section.

At the inlet side 10 of vaporization chamber 4 an aperature is provided to accommodate an air conduit 12 and a fuel conduit 14. Fuel is supplied under atmospheric pressure to fuel conduit 14 by any suitable means as diagrammatically represented in phantom box 15. In the preferred embodiment, air conduit 12 is coaxially mounted within fuel conduit 14. This permits a symmetrical, uniform convergence of the fuel and air in the vaporization chamber 4. However, separate lines could be provided which would converge in a suitable manner within vaporization chamber 4.

At the inlet end of air conduit 12 there is provided an air supply valve 16 shown in detail in FIG. 1B. Air supply valve 16 consists of a valve chamber 18 which is provided to accommodate an air filter 20. A valve stem 22 is provided with a mating seal sleeve 24. Valve stem 22 is a hollow, tube-shaped piece, closed at its inlet end 23 and provided with one or more openings 25 preferably in the shape of an elongated rectangular slot parallel to the longitudinal axis. Such as slot has been found to permit a desirable linear variation in air flow. A spring 26 holds the valve stem 22 inside seal sleeve 24. In this manner, air is permitted into air conduit 12 only when the vacuum force is sufficient to overcome the force of spring 26.

Fuel conduit 14 and air conduit 12 converge at their outlet ends within vacuum chamber 4. In the embodiment shown in FIG. 1A, the air conduit 12 and fuel conduit 14 are coaxial and the end of fuel conduit 14 extends slightly beyond the end of air conduit 12. In the preferred embodiment, air conduit 12 may be axially adjusted relative to fuel conduit 14 and vaporization chamber 4. This may be accomplished either by manually sliding air conduit 12 in or out of fuel conduit 14 and vaporization chamber 4 or by other suitable means. In this manner, the distance between the outlet end of air conduit 12 and the barrier 28 may be adjusted for optimum vaporization.

Vaporization chamber 4 is divided into two internal regions by barrier 28, vaporizing and mixing region 32 and vacuum region 34. A small diffusion orifice 30 is provided in barrier 28 to create a partial vacuum in the vaporization chamber 4 and to permit the passage of the vaporized fuel and air supplied by fuel conduit 14 and air conduit 12.

In operation, the internal combustion engine creates a vacuum which draws air and fuel through air conduit 12 and fuel conduit 14 into the mixing and vaporizing region 32 of vaporization chamber 4. A combination of vaporized fuel and air are drawn out of the vaporizing and mixing region 32 through orifice 30 into vacuum region 34 and out of the vaporization chamber 4 by conduit 36. As stated above, a means may be provided for varying the distance between the outlet end of air conduit 12 and the barrier 28. The richness of the vaporized fuel/air mixture exiting the vaporization chamber 4 is affected by numerous factors, notably the air flow resistance provided by valve 16, the size of orifice 30 and the distance between orifice 30 and the outlet end of air conduit 12.

The vaporized fuel/air mixture drawn from vaporization chamber 4 through conduit 36 passes through choke control 6. Choke control 6 enables the operator to permit or deny access of additional air to conduit 36. This causes the final mixture provided to the engine to be richer or leaner, as desired. After adjustment for richness, the vaporized fuel/air mixture passes through safety screen 7, throttle 8 and into the inlet manifold 2. Safety screen 7 presents a flame barrier in the event of a backfire from the engine. Safety screen 7 may be made of conventional screen material or may be made of fireproof material such as asbestos.

Figure 2:
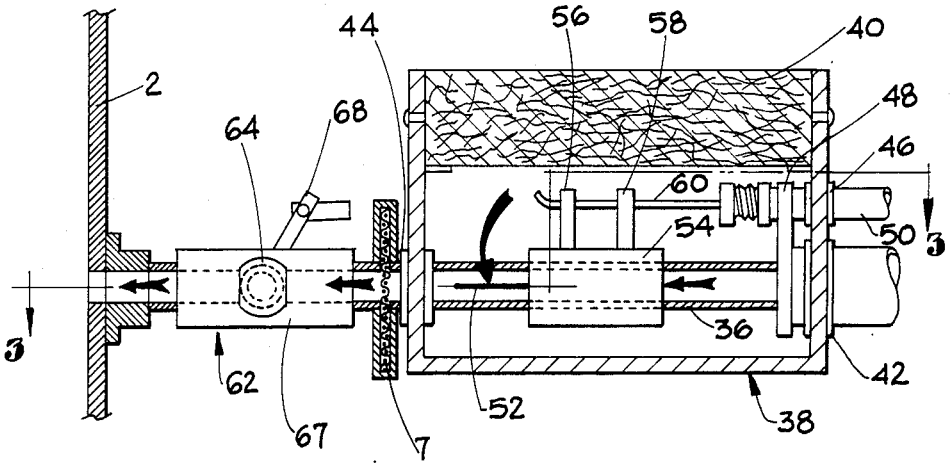
FIG. 2 is a detailed elevational view of the choke and throttle mechanism associated with the present invention.
Figure 3:
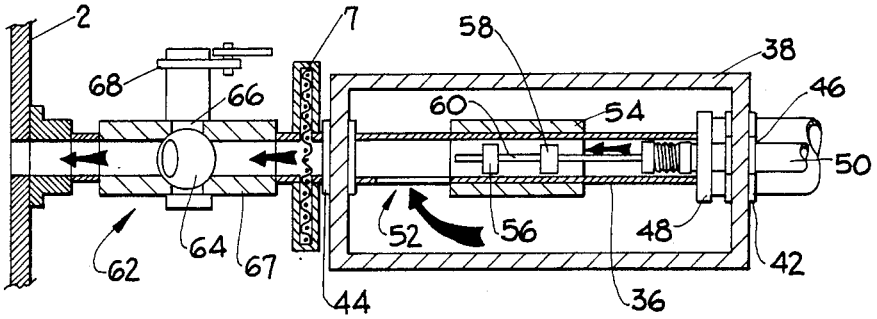
FIG. 3 is a plan view of FIG. 2.

Turning now to FIGS. 2 and 3, choke control 6 and throttle 8 are shown in greater detail. While only a single choke control and throttle are illustrated, each may be mounted in a series to supply each cylinder inlet manifold individually.

Turning first to the choke control 6, there is provided a choke housing 38 to enclose a portion of conduit 36 and protect the conduit 36 from contaminants. An air filter 40, not shown in FIG. 3, is retained within an opening in housing 38. Housing 38 is also provided with aperatures and retainers 42 and 44 which accommodate conduit 36. Housing 38 also is provided with an aperature 46 and a mounting bracket 48 suitable to accommodate a shielded control cable 50. An opening 52 is provided in conduit 36 at a location within the choke housing 38. In the preferred embodiment, opening 52 is an elongated rectangular slot which has been found to provide excellent linear control attributes. Choke slide 54 is provided with an inside diameter slightly greater than the outside diameter of conduit 36. Choke slide 54 includes two mounting flanges 56 and 58 to which the internal cable 60 of the shielded control cable 50 is attached. With this configuration, an operator or an automated choke control can adjust choke slide 54 on conduit 36 by remote control using the shielded control cable 50.

The position of choke slide 54 on conduit 36 affects the richness of the vaporized fuel/air mixture entering throttle 62. If the choke slide 54 is in its extreme forward position nearest the inlet manifold 2, the vaporized fuel/air mixture will be unchanged from that provided by vaporization chamber 4 shown in FIG. 1. However, if the choke slide 54 is retracted away from inlet manifold 2, additional air is drawn into conduit 36 by the engine vacuum after passing through filter 40, and the vaporized fuel/air mixture is made leaner.

The vaporized fuel/air mixture exiting the choke control assembly enters throttle 62. Throttle 62 consists of a ball valve 64 mounted within a tubular housing 67. The ball valve 64 is mounted on shaft 66 which may be rotated within housing 67 by crank 68 which is rigidly mounted to shaft 66. The ball valve 64 includes an aperature through its center which is of substantially equal diameter to the aperature through housing 67. When the ball valve 64 aperature is aligned with the aperature of housing 67, the flow of vaporized fuel-air mixture into inlet manifold 2 is unrestrained. However, if crank 68 is moved, causing rotation of ball valve 64 on shaft 66 relative to housing 67, the flow of vaporized fuel/air mixture will be reduced, causing the engine to lose speed and power.

Figure 4:
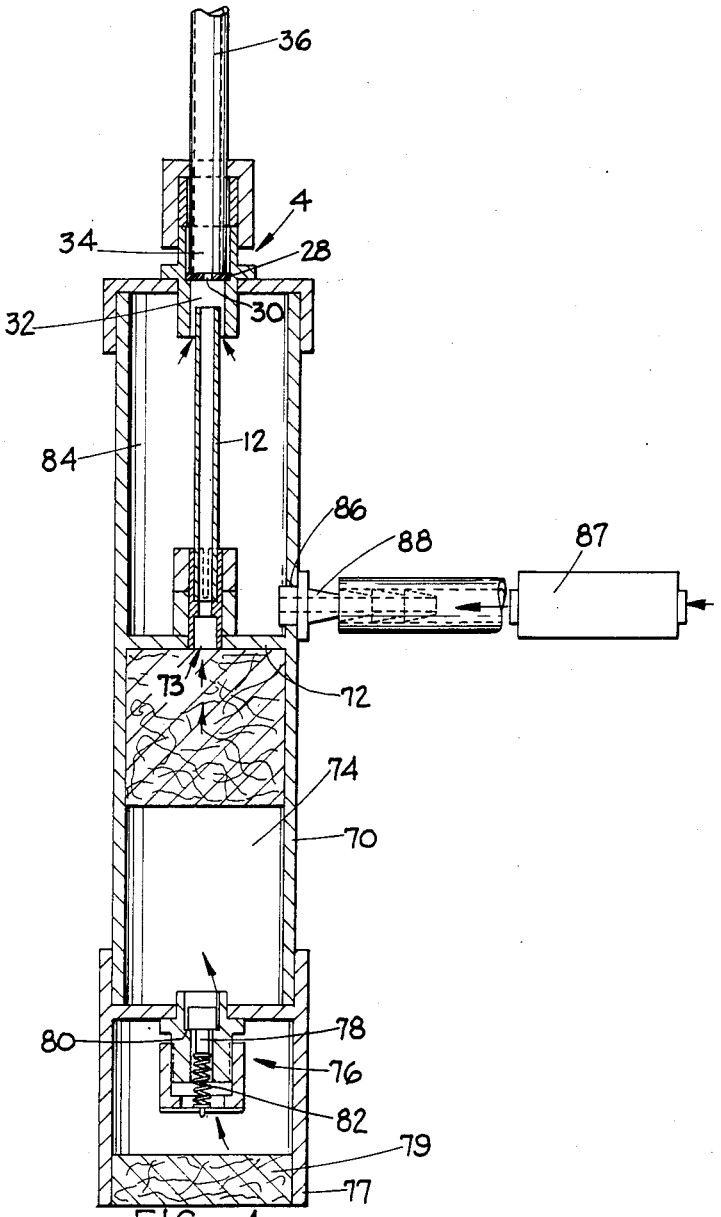
FIG. 4 is a fragmentary cross-sectional elevational view of an alternate embodiment of the present invention.

Turning now to FIG. 4, an alternate embodiment of the vaporization chamber of the present invention is shown. A tank 70 is provided as a staging area for the vaporization chamber 4. Tank 70 is divided into fuel and air regions by separation wall 72. Air chamber 74 receives its air supply from air intake valve 76 which is protected from contaminants by valve housing 77 and filter 79. The air intake valve 76 includes a valve stem 78 and valve seat 80. The valve stem is held in contact with valve seat 80 by the force of valve spring 82. As with the previous embodiment, this permits air to enter air chamber 74 only when the engine vacuum is sufficient to overcome the force of valve spring 82. Tank 70 is provided with an aperature at 86 to accommodate fuel conduit 88. Fuel is drawn by the force of the engine vacuum through fuel filter 87 and fuel conduit 88 into fuel chamber 84.

Separation wall 72 includes an aperature 73 through which there is mounted an air conduit 12. Air conduit 12 terminates at its outlet end in vaporization chamber 4. Vaporization chamber 4 extends from tank 70 opposite the end on which the inlet valve 76 is mounted. Vaporization chamber 4 is divided into a vaporizing and mixing region 32 and a vacuum region 34 by barrier 28. A small diffusion orifice 30 is provided in barrier 28 to create a partial vacuum in the vaporization chamber 4 and to permit the mixture of fuel and air to pass into vacuum region 34. In operation, the vacuum produced by the engine draws fuel and air into tank 70 and into vaporization chamber 4. In this manner, fuel and air are simultaneously provided to the vaporizing and mixing region 32 of vaporization chamber 4 adjacent the diffusion orifice 30. The engine vacuum draws a vaporized fuel/air mixture through orifice 30 and into vacuum region 34. From there it is drawn out of vaporization chamber 4 by conduit 36. After passing through the choke control 6, safety screen 7 and throttle control 8, illustrated in FIGS. 1A, 2, and 3, the vaporized fuel/air mixture enters inlet manifold 2 and is supplied to the engine cylinders. In the preferred embodiment, a means may be provided for adjusting the distance between barrier 28 and the outlet end of air conduit 12.

The foregoing description of a preferred embodiment and alternative embodiments of the invention have been presented for purposes of illustration and description. The description is not intended to be exhaustive or to limit the invention to the precise form disclosed. Obviously, many modifications and variations are possible in light of the above teaching. The embodiment presented above was chosen and described in order to best explain the principles of the invention and its practical application to thereby enable others skilled in the art to best utilize the invention in various embodiments and with various modifications as are suited to the particular use contemplated.

What is claimed is:

1. An apparatus for vaporizing and controlling a fuel/air mixture for use in an internal combustion engine, said apparatus comprising:

(a) a vacuum-tight vaporization chamber;

(b) a fuel conduit affixed at its inlet end to a fuel supply and at its outlet end to said chamber;

(c) an air conduit affixed at its inlet end to an air supply and at its outlet end to said chamber;

(d) barrier means mounted inside said chamber adjacent said respective outlet ends of said fuel and air conduits, said barrier means partitioning said chamber into at least a first region and a second region, said barrier means including an orifice;

(e) means for immediately and simultaneously mixing said air with said fuel in said first region of said chamber;

(f) air intake valve means mounted to said inlet end of said air conduit; and (g) conduit means for conducting a vaporized fuel/air mixture from said chamber to said internal combustion engine;

whereby a vacuum in said engine draws fuel and air through their respective conduits to the first region of said chamber wherein the pressure differential in said chamber causes the air and fuel to form a vapor which is drawn through said orifice and said conduit means into said engine.

2. The apparatus according to claim 1 further comprising means to adjust the distance between said air outlet end and said barrier means.

3. The apparatus according to claim 1 wherein the means for simultaneously mixing said air and fuel comprises said air outlet end coaxially mounted within said fuel outlet end, said fuel outlet end mounted within said first region of said chamber.

4. The apparatus according to claim 3 wherein said fuel outlet end extends slightly beyond said air outlet end.

5. The apparatus according to claim 3 further comprising means to axially adjust said air outlet end with respect to said fuel outlet end.

6. The apparatus according to claim 5 further comprising a choke assembly, said choke assembly comprising;

(a) means for guarding a region of said conduit means against contamination; and (b) adjustable means for sealing an opening provided in said conduit means at a location in said guarded region.

7. The apparatus according to claim 6 wherein said air intake valve means comprises:

(a) a sealing sleeve;

(b) a tubular valve stem, closed at its inlet end and including an opening through its side wall, slidably mounted within said sealing sleeve; and (c) means responsive to the vacuum presented at the inlet end of said valve stem for adjustably retaining said valve stem within said sealing sleeve.

8. A fuel vaporizing and control apparatus adapted for use in an internal combustion engine, said apparatus comprising:

(a) a vacuum-tight vaporization chamber;

(b) a fuel supply conduit affixed to said vaporization chamber for admitting fuel to said chamber;

(c) an air supply cnduit having an inlet end and an outlet end, said outlet end affixed to said vaporization chamber for admitting air to said chamber;

(d) a flow-resistant air inlet valve mounted to the inlet end of said air supply conduit;

(e) a barrier containing a diffusion orifice mounted within said vaporization chamber adjacent said outlet end of said air supply conduit wherein the distance between said outlet end of said air supply conduit and said barrier is adjustable; and (f) a vapor conduit for conducting a vaporized fuel/air mixture out of said vaporization chamber to said internal combustion engine.

9. The apparatus according to claim 8 wherein said flow-resistant air inlet valve comprises:

a sealing sleeve;

a tubular valve stem closed at its inlet end and, including an opening through its side wall, slidably mounted within said sealing sleeve; and means responsive to the vacuum presented at the inlet end of said valve stem for adjustably retaining said valve stem within said sealing sleeve.

10. A fuel vaporizing and control apparatus adapted for use in an internal combustion engine, said apparatus comprising:

(a) a vacuum-tight vaporization chamber;

(b) a fuel supply conduit affixed to said vaporization chamber for admitting fuel to said chamber;

(c) an air supply conduit having an inlet end and an outlet end, said outlet end affixed to said vaporization chamber for admitting air to said chamber;

(d) a flow-resistant air inlet valve mounted to the inlet end of said air supply conduit wherein said valve comprises:

(i) a sealing sleeve;

(ii) a tubular valve stem closed at its inlet end and, including an opening through its side wall, slidably mounted within said sealing sleeve; and (iii) means responsive to the vacuum presented at the inlet end of said valve stem for adjustably retaining said valve stem within said sealing sleeve;

(e) a barrier containing a diffusion orifice mounted within said vaporization chamber adjacent said outlet end of said air supply conduit; and (f) a vapor conduit for conducting a vaporized fuel-/air mixture out of said vaporization chamber to said internal combustion engine.

11. A fuel vaporizing and control apparatus adapted for use in an internal combustion engine, said apparatus comprising:

(a) a vacuum-tight vaporization chamber;

(b) a fuel supply conduit affixed to said vaporization chamber for admitting fuel to said chamber;

(c) an air supply conduit having an inlet end and an outlet end, said outlet end affixed to said vaporization chamber for admitting air to said chamber;

(d) a flow-resistant air inlet valve mounted to the inlet end of said air supply conduit;

(e) a barrier containing a diffusion orifice mounted within said vaporization chamber adjacent said outlet end of said air supply conduit;

(f) a vapor conduit for conducting a vaporized fuel-/air mixture out of said vaporization chamber to said internal combustion engine; and (g) a choke assembly comprising:

(i) means for guarding a region of said vapor conduit against contamination; and (ii) an adjustable means for sealing an opening provided in said vapor conduit at a location in said guarded region.

12. The apparatus according to claim 11 wherein said flow-resistant air inlet valve comprises:

a sealing sleeve;

a tubular valve stem closed at its inlet end and, including an opening through its side wall, slidably mounted within said sealing sleeve; and means responsive to the vacuum presented at the inlet end of said valve stem for adjustably retaining said valve stem within said sealing sleeve.

13. The apparatus according to claim 11 wherein the distance between said outlet end of said air supply conduit and said barrier is adjustable.

14. The apparatus according to claim 13 wherein said flow-resistant air inlet valve comprises:

a sealing sleeve;

a tubular valve stem closed at its inlet end and, including an opening through its side wall, slidably mounted within said sealing sleeve; and means responsive to the vacuum presented at the inlet end of said valve stem for adjustably retaining said valve stem within said sealing sleeve.

15. An apparatus for vaporizing and controlling a fuel/air mixture for use in an internal combustion engine, said apparatus comprising:

(a) tank means divided into a fuel region and an air region;

(b) a fuel conduit affixed at its inlet end to a fuel supply and at its outlet end to said fuel region;

(c) air intake valve means in communication with said air region;

(d) an air conduit having an inlet in communication with said air region and an outlet in communication with said fuel region;

(e) a chamber partitioned by barrier means into a vaporizing region and a vacuum region, said chamber mounted in communication with said fuel region adjacent said air conduit outlet, said barrier means including an orifice for passage of a vaporized fuel/air mixture from said vaporizing region to said vacuum region; and (f) conduit means for conducting a vaporized fuel/air mixture from said vacuum region to said internal combustion engine.

16. The apparatus according to claim 15 further comprising means to adjust the distance between said air conduit outlet and said barrier means.

17. The apparatus according to claim 16 further comprising a choke assembly, said choke assembly comprising:

(a) means for guarding a region of said conduit means against contamination; and (b) adjustable means for sealing an opening provided in said conduit means at a location in said guarded region.

18. The apparatus according to claim 17 wherein said air intake valve means comprises:

(a) a sealing sleeve;

(b) a tubular valve stem, closed at its inlet end and including an opening through its side wall, slidably mounted within said sealing sleeve; and (c) means responsive to the vacuum presented at the inlet end of said valve stem for adjustably retaining said valve stem within said sealing sleeve.

* * * * *